US006321477B1

(12) United States Patent
Watson Jr.

(10) Patent No.: US 6,321,477 B1
(45) Date of Patent: Nov. 27, 2001

(54) ADJUSTABLE AND LOCKING RIFLE MOUNTING SYSTEM

(75) Inventor: Fred W. Watson Jr., Montross, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/294,445

(22) Filed: Mar. 31, 1999

(51) Int. Cl.[7] ..... F41A 21/00
(52) U.S. Cl. ..... 42/75.02; 42/75.01; 89/1.813
(58) Field of Search ..... 42/75.02, 75.01, 42/105, 100, 101; 89/1.816, 1.7, 28.05, 194, 127, 1.813, 138, 1.814

(56) References Cited

U.S. PATENT DOCUMENTS

| | | | | |
|---|---|---|---|---|
| 3,098,410 | * | 7/1963 | Giza | 89/1.7 |
| 4,228,605 | | 10/1980 | Chacornac | 42/1 R |
| 4,273,026 | | 6/1981 | Walter | 89/37 R |
| 4,841,659 | * | 6/1989 | Williams | 42/101 |
| 4,873,779 | * | 10/1989 | Ellison et al. | 42/101 |
| 4,919,036 | | 4/1990 | Eng | 89/37.11 |
| 5,657,546 | * | 8/1997 | Canaday | 33/235 |
| 5,659,965 | * | 8/1997 | Thibodeau et al. | 33/261 |
| 5,719,349 | | 2/1998 | Canaday et al. | 89/1.816 |
| 5,732,499 | | 3/1998 | Canaday et al. | 42/75.02 |
| 5,802,755 | | 9/1998 | Tortorici et al. | 42/75.02 |

* cited by examiner

*Primary Examiner*—Michael J. Carone
*Assistant Examiner*—John Richardson
(74) *Attorney, Agent, or Firm*—James B. Bechtel; Peter J. Van Bergen

(57) ABSTRACT

A mounting system for a cylindrical object such as a spotting rifle is provided. First and second U-shaped brackets are coupled to a base such as a launching device. Each U-shaped bracket has first and second legs extending from a common base. The two U-shaped brackets are oriented such that the first and second legs of one U-shaped bracket are perpendicular to the first and second legs of the other U-shaped bracket. Each U-shaped bracket slidably receives a sleeve between its first and second legs. Each sleeve is attachable to the bracket's common base such that the position of the sleeve relative to the bracket's common base is adjustable. A locking mechanism is provided with each U-shaped bracket/sleeve combination to lock the sleeve laterally between the first and second legs of the U-shaped bracket. The two sleeves are coaxially aligned.

16 Claims, 2 Drawing Sheets

102
10
11
12
13
133
17
150
15
16
14
151
152
102A
20
21
250
25
251
24
23
27
26
281
280
282
280
31
32
33
34
30
18
182
180
181
100C
100A
100B
100F
100D
100E
100

ADJUSTABLE AND LOCKING RIFLE MOUNTING SYSTEM

ORIGIN OF THE INVENTION

The invention described herein was made in the performance of official duties by an employee of the Department of the Navy and nay be manufactured, used, licensed by or for the Government for any governmental purpose without payment of any royalties thereon.

FIELD OF THE INVENTION

The invention relates generally to gun mounts, and more particularly to a mounting system that allows a rifle to be adjusted and locked relative to a base as is the case when a spotting rifle must be mounted to a launching device for purposes of setting the range for the launching device.

BACKGROUND OF THE INVENTION

Spotting or tracer rifles are used to determine range to a target. In general, the spotting rifle is set for a specific range and a tracer or burning round is fired to see if the selected range was accurate. If not, corrections are made until the correct range is achieved.

Frequently, a spotting rifle is coupled to another launching device. That is, the spotting rifle is used to select the range for the launching device. Accordingly, it is desirable to align the site of the spotting rifle with that of the launching device. To do this, the spotting rifle and launching device must be attached to one another. Generally, a series of alignment adjustments are made before the two are fixedly coupled to one another. The adjusting and locking mechanism(s) used to couple the spotting rifle and launching device must be capable of aligning and then stabilizing the relationship therebetween, and withstanding recoil forces. This is increasingly important and more difficult as the desired launch range of operation increases.

SUMMARY OF THE INVENTION

Accordingly, it is an object of the present invention to provide an adjustable and lockable mechanism for mounting a spotting or other rifle to a base.

Another object of the present invention is to provide an adjustable and lockable mechanism for coupling a spotting rifle to a launching device in an aligned relationship.

Other objects and advantages of the present invention will become more obvious hereinafter in the specification and drawings.

In accordance with the present invention, a mounting system for a cylindrical object is provided. A first bracket, coupled to a base, is U-shaped with first and second legs extending from a common base. A first sleeve is slidably mounted between the first and second legs of the first bracket. The first sleeve is attachable to the common base of the first bracket such that the position of the first sleeve relative to the common base of the first bracket is adjustable. A first locking mechanism locks the first sleeve laterally between the first and second legs of the first bracket when the first sleeve has been positioned relative to the common base of the first bracket. A second bracket is spaced apart from the first bracket and is coupled to the base. The second bracket is also U-shaped with first and second legs extending from a common base. The second bracket is positioned with its first and second legs oriented perpendicular to the first and second legs of the first bracket. A second sleeve is slidably mounted between the first and second legs of the second bracket. The second sleeve is attachable to the common base of the second bracket such that the position of the second sleeve relative to the common base of the second bracket is adjustable. A second locking mechanism locks the second sleeve laterally between the first and second legs of the second bracket when the second sleeve has been positioned relative to the common base of the second bracket. The first sleeve and second sleeve are coaxially aligned.

DETAILED DESCRIPTION OF THE INVENTION

Figure 1:
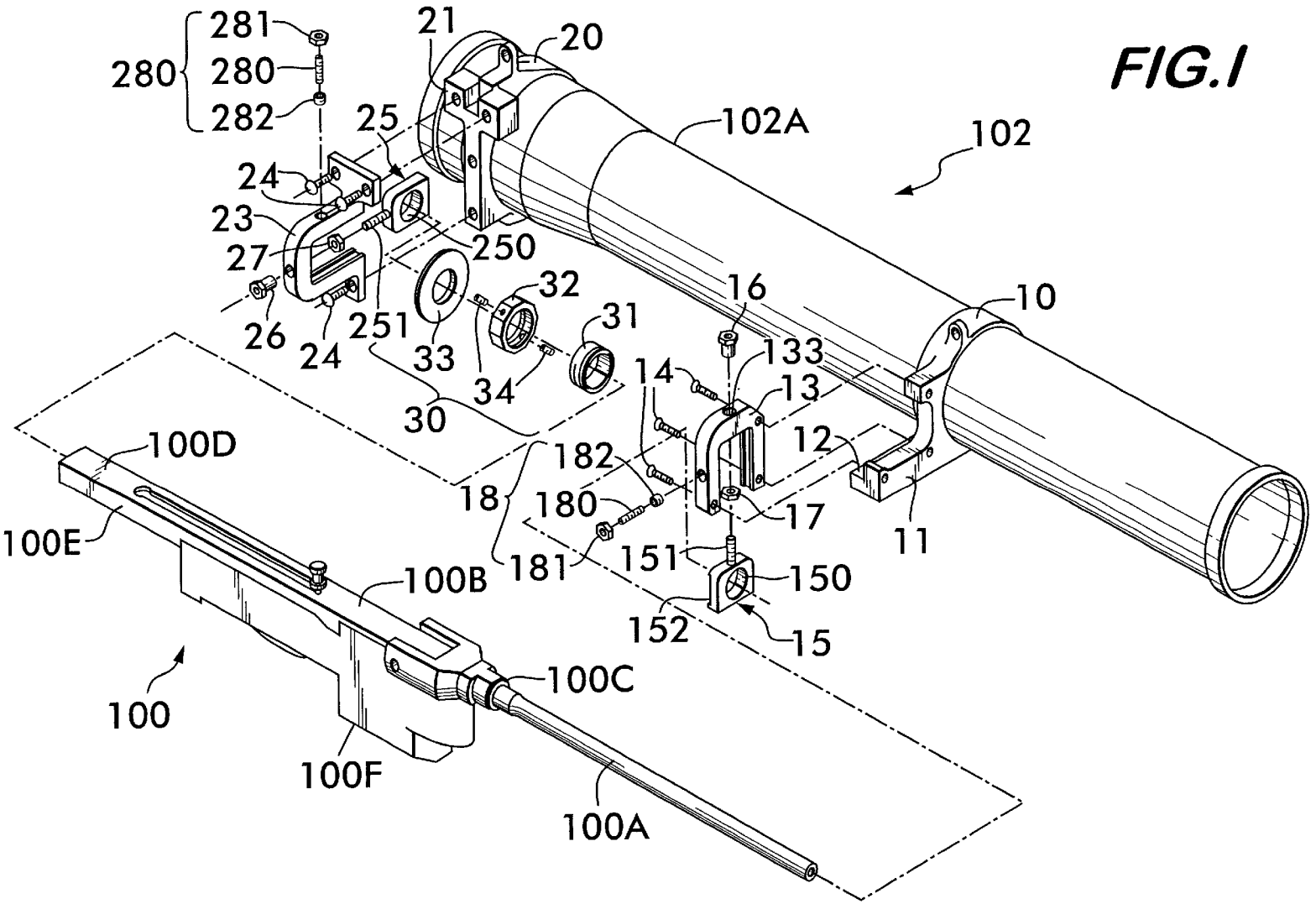
FIG. 1 is an exploded view of an embodiment of the adjustable and locking rifle mounting system in accordance with the present invention as it is used to couple a spotting rifle to a launch tube.

Referring now to the drawings and more particularly to FIG. 1, the adjustable and locking rifle mounting system of the present invention is illustrated in an exemplary embodiment thereof in which a spotting rifle 100 is mounted to a launching device 102. By way of example, spotting rifle 100 and launching device 102 are the U.S. Navy's Shoulder-Launched, Multi-Purpose Assault Weapon (SMAW) launching system. However, it is to be understood that the present invention could be used to mount any spotting rifle to any launching device. Even more generally, the present invention can be used to adjustably mount and lock any cylindrical object to a base.

The portions of rifle 100 and launching device 102 relevant to the present invention are illustrated and will be described briefly. Rifle 100 includes a barrel 100A installed in a receiver housing 100B extending from a forward portion 100C to an aft portion 100D which has planar sides 100E. Receiver housing 100B is supported on a trigger housing 100F. The relevant portion of launching device 102 is its launch tube 102A.

Figure 2:
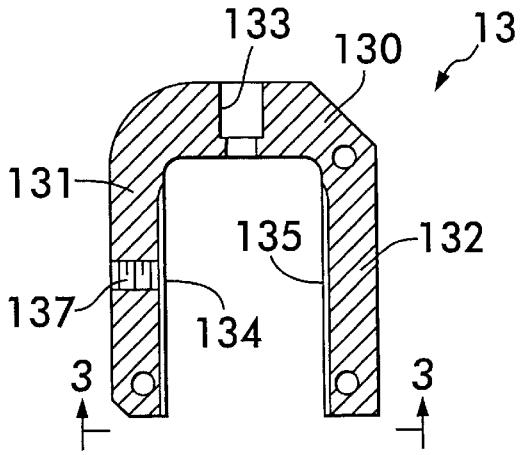
FIG. 2 is an isolated cross-sectional view of the fore U-shaped bracket.
Figure 3:
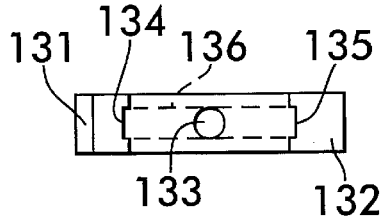
FIG. 3 is an end view of the fore U-shaped bracket taken along line 3—3 of FIG. 2.

Rifle 100 is adjustably positioned relative to launching device 102 by fore and aft bracketing arrangements. The fore bracketing arrangement (located forward of receiver housing 100B) includes a base or mounting platform 10 attached to a forward end of launch tube 102A. Base 10 defines an L-shaped flange 11 having a horizontal ledge 12 extending therefrom. A U-shaped mounting bracket 13 fits above ledge 12 and is fixedly attached to flange 11 by plurality of fasteners, e.g., screws 14. Base 10 positions bracket 13 in a plane perpendicular the longitudinal, i.e., firing, axis of launching device 102. Referring now additionally to FIGS. 2 and 3, bracket 13 has a base 130 with legs 131 and 132 extending therefrom. A hole 133 is provided in base 130. Legs 131 and 132 have respective grooves 134 and 135 formed therealong. Grooves 134 and 135 oppose one another such that a longitudinal slot is defined by bracket 13 as illustrated by the dashed line rectangle 136 shown in FIG. 3. A threaded hole 137 is provided in leg 131.

Slidably fitted within slot 136 is a sleeve plate 15 defining a sleeve 150 receiving and cradling a forward portion of rifle 100 as will be explained further below. Extending from sleeve plate 15 is a threaded post 151 which, when sleeve plate 15 is slid into slot 136, passes through hole 133. To threadably engage post 151 and lock same into a desired longitudinal position within slot 136, a threaded sleeve 16 and locking nut 17 engage post 151 on either side of base 130.

To eliminate lateral play of sleeve plate 15 in slot 136, a set screw assembly is used in conjunction with hole 137 to apply lateral pressure to sleeve plate 15. By way of example, a set screw assembly 18 is illustrated and includes a set screw 180, and may include a locking nut 181 and/or a helical insert 182. If bracket 13 is made from a strong material, e.g., steel, set screw 180 is threaded into hole 137 and torqued to fix the lateral position of sleeve plate 15. Locking nut 181 is then tightened against leg 131 to lock the position of set screw 180. However, if a self-locking set screw is used, locking nut 181 is not necessary. Further, if bracket 13 is made from a lightweight material (e.g., aluminum, a composite, etc.) such that the threads in hole 137 could deform under high torque loads, a self-locking steel helical insert 182 could be threaded into hole 137 to receive set screw 180. Note that if a standard steel helical insert is used, locking nut 181 may still be necessary.

The aft bracketing arrangement (located aft of trigger housing 100F) in the present invention is similar in construction to the fore bracketing arrangement. Specifically, a base or mounting platform 20 is attached to an aft end of launch tube 102A. Base 20 defines a mounting flange 21 that is perpendicular to flange 11 of base 10. A U-shaped mounting bracket 23 is turned sideways, i.e., 90° with respect to U-shaped bracket 13, and is fixedly attached to mounting flange 21 by a plurality of fasteners, e.g., screws 24. Base 20 positions bracket 23 in a plane parallel to that of bracket 13.

Figure 4:
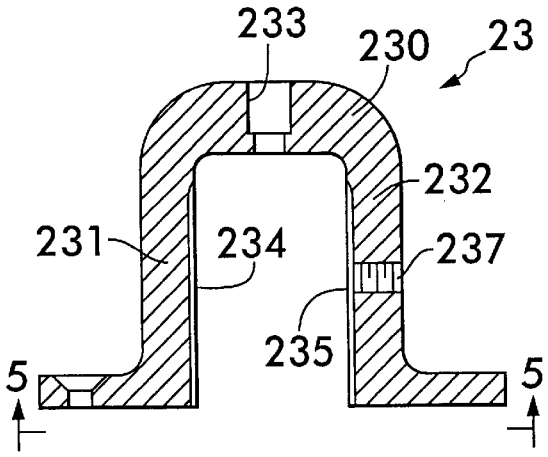
FIG. 4 is an isolated cross-sectional view of the aft U-shaped bracket.
Figure 5:
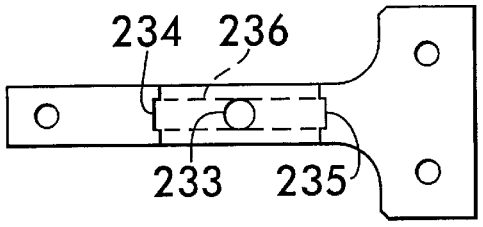
FIG. 5 is an end view of the aft U-shaped bracket taken along line 5—5 of FIG. 4.

Referring now additionally to FIGS. 4 and 5, bracket 23 has a base 230 with legs 231 and 232 extending therefrom. A hole 233 is provided in base 230. Legs 231 and 232 have respective grooves 234 and 235 formed therealong. Grooves 234 and 235 oppose one another such that a longitudinal slot is defined by bracket 23 as illustrated by the dashed line rectangle 236 shown in FIG. 5. A threaded hole 237 is provided in leg 232.

Slidably fitted within slot 236 is a sleeve plate 25 defining a sleeve 250 receiving and cradling an aft portion of rifle 100 as will be explained further below. Extending from sleeve plate 25 is a threaded post 251 which, when sleeve plate 25 is slid into slot 236, passes through hole 233. To threadably engage post 251 and lock same into a desired longitudinal position within slot 236, a threaded sleeve 26 and locking nut 27 engage post 251 on either side of base 230.

To eliminate lateral play of sleeve plate 25 in slot 236, a set screw assembly is used in conjunction with hole 237 to apply lateral pressure to sleeve plate 25. By way of example, a set screw assembly 28 is illustrated and includes a set screw 280, and may include a locking nut 281 and/or a helical insert 282. Operation of set screw assembly 28 is the same as set screw assembly 18.

As will be explained below, the above-described mounting system is used to adjust and lock together any cylindrical object to a base in terms of the vertical and horizontal directions. However, when used to couple rifle 100 to launching device 102, rifle 100 must also be restrained against axial movement and absorb recoil forces. Accordingly, by way of example, one way of fixing the axial position of rifle 100 relative to launching device 102 is illustrated and will now be explained. Referring again to FIG. 1, an axial restraint or locking mechanism 30 includes an externally-threaded ring 31, a tension nut 32, a spring plate 33 (e.g., a Belleville washer), and set screws 34. Ring 31 is fitted over the aft portion of rifle 100 and is indexed thereto (e.g., via planar sides 100E of rifle receiver housing 100B) to prevent any rotation of ring 31 about rifle 100. In the illustrated example, ring 31 can move axially until it abuts trigger housing 100F. Tension nut 32 is threaded on to ring 31. Spring plate 33 fits over rifle 100 and is sized to abut tension nut 32 and legs 231 and 232 of bracket 23 when axial restraint mechanism 30 is in use. The function of spring plate 33 could also be achieved using a plurality of Belleville washers or a coiled spring. Set screw(s) 34 can be screwed through tension nut 32 to engage ring 31 in order to lock nut 32 in position relative to ring 31.

In use of the present invention, axial restraint mechanism 30 is fitted onto rifle 100 as explained above. The aft portion 100D of receiver housing 100B is slipped through sleeve plate 25 which is fitted into bracket 23 attached to base 20. Sleeve plate 15 is fitted over barrel 100A until it abuts forward portion 100C of receiver housing 100B. Note that the face of sleeve plate 15 abutting forward portion 100C can be shaped (e.g., notched at 152 in the illustrated example) to nest with forward portion 100C. Sleeve plate 15 is then slid into bracket 13 as described above and attached to base 10. Sleeve plates 15 and 25 are adjusted longitudinally in their respective slots using threaded sleeves 16 and 26, respectively, and then locked longitudinally using locking nuts 17 and 27, respectively. Sleeve plates 15 and 25 are then locked laterally in their respective slots using set screw assemblies 18 and 28, respectively. Finally, tension nut 32 is rotated back from ring 31 until spring plate 33 is pressed up against bracket 23. At this point, rifle 100 is driven forward until forward portion 100C of receiver housing 100B is pressed up against sleeve plate 15 to axially lock rifle 100 between the fore and aft bracketing arrangements.

The advantages of the present invention are numerous. The mounting system allows a rifle or any other cylindrical object to be adjustably positioned and then locked in position relative to a base, e.g., a launching device. The lateral and longitudinal locking mechanisms provided with each U-shaped bracket stabilize the rifle's position thereby increasing its effective range of operation.

Although the invention has been described relative to a specific embodiment thereof, there are numerous variations and modifications that will be readily apparent to those skilled in the art in light of the above teachings. For example, different mechanisms could be used to lock sleeve plates 15 and 25 both longitudinally and laterally in their respective brackets. Further, other axial restraint mechanisms can be used in place of mechanism 30 depending on the type of rifle being used. It is therefore to be understood that, within the scope of the appended claims, the invention may be practiced other than as specifically described.

What is claimed as new and desired to be secured by Letters Patent of the United States is:

1. A mounting system for use in combination with a cylindrical object comprising:

a first bracket coupled to a base, said first bracket being U-shaped with first and second legs extending from a common base;

a first sleeve capable of receiving a cylindrical object herethrough, said first sleeve slidably mounted between said first and second legs of said first bracket, said first sleeve being attachable to said common base of said first bracket such that a position of said first sleeve relative to said common base of said first bracket is adjustable;

a first locking mechanism for locking said first sleeve laterally between said first and second legs of said first bracket when said first sleeve has been positioned relative to said common base of said first bracket;

a second bracket spaced apart from said first bracket and coupled to the base, said second bracket being U-shaped with first and second legs extending from a common base, said second bracket positioned with said first and second legs thereof oriented perpendicular to said first and second legs of said first bracket;

a second sleeve capable of receiving the cylindrical object therethrogh, said second sleeve slidably mounted between said first and second legs of said second bracket, said second sleeve being attachable to said common base of said second bracket such that a position of said second sleeve relative to said common base of said second bracket is adjustable; and a second locking mechanism for locking said second sleeve laterally between said first and second legs of said second bracket when said second sleeve has been positioned relative to said common base of said second bracket.

2. A mounting system as in claim 1, further comprising means for fixing an axial position of the cylindrical object relative to said first sleeve and said second sleeve.

3. A mounting system as in claim 1, further comprising base brackets mounted to the base for defining mounting platforms for each of said first bracket and said second bracket.

4. A mounting system as in claim 1, further comprising a hole in said common base of said first bracket and a threaded post extending from said first sleeve and passing through said hole in said common base of said first bracket, said mounting system further comprising a threaded coupling threadably engaging said threaded post of said first sleeve.

5. A mounting system as in claim 4, further comprising means for locking said threaded coupling to said threaded post when said threaded post is engaged with said threaded coupling and said first sleeve is positioned as desired relative to said common base of said first bracket.

6. A mounting system as in claim 1, further comprising a hole in said common base of said second bracket and a threaded post extending from said second sleeve and passing through said hole in said common base of said second bracket, said mounting system further comprising a threaded coupling threadably engaging said threaded post of said second sleeve.

7. A mounting system as in claim 6, further comprising means for locking said threaded coupling to said threaded post when said threaded post is engaged with said threaded coupling and said second sleeve is positioned as desired relative to said common base of said second bracket.

8. A mounting system for use in combination with a cylindrical object comprising:

base brackets mounted to a base for defining spaced-apart mounting platforms;

a first bracket coupled to one of said base brackets, said first bracket being U-shaped with first and second grooved legs extending from a common base to define a first slot;

a first sleeve capable of receiving a cylindrical object therethrough, said first sleeve slidably engaged in said first slot, said first sleeve being attachable to said common base of said first bracket such that a position of said first sleeve relative to said common base of said first bracket is adjustable;

a first locking mechanism for locking said first sleeve laterally in said first slot when said first sleeve has been positioned relative to said common base of said first bracket;

a second bracket coupled to another of said base brackets, said second bracket being U-shaped with first and second grooved legs extending from a common base to define a second slot, said second bracket positioned with said first and second grooved legs thereof oriented perpendicular to said first and second grooved legs of said first bracket in a plane parallel to that of said first bracket;

a second sleeve capable of receiving the cylindrical object therethrough, said second sleeve slidably engaged in said second slot, said second sleeve being attachable to said common base of said second bracket such that a position of said second sleeve relative to said common base of said second bracket is adjustable;

a second locking mechanism for locking said second sleeve laterally in said second slot when said second sleeve has been positioned relative to said common base of said second bracket; and said base brackets in combination with said first bracket and said second bracket positioning said first sleeve coaxially with said second sleeve.

9. A mounting system as in claim 8, further comprising means for fixing an axial position of the cylindrical object relative to said first sleeve and said second sleeve.

10. A mounting system as in claim 8, further comprising a hole in said common base of said first bracket and a threaded post extending from said first sleeve and passing through said hole in said common base of said first bracket, said mounting system further comprising a threaded coupling threadably engaging said threaded post of said first sleeve.

11. A mounting system as in claim 10, further comprising means for locking said threaded coupling to said threaded post when said threaded post is engaged with said threaded coupling and said first sleeve is positioned as desired relative to said common base of said first bracket.

12. A mounting system as in claim 8, further comprising a hole in said common base of said second bracket and a threaded post extending from said second sleeve and passing through said hole in said common base of said second bracket, said mounting system further comprising a threaded coupling threadably engaging said threaded post of said second sleeve.

13. A mounting system as in claim 12, further comprising means for locking said threaded coupling to said threaded post when said threaded post is engaged with said threaded coupling and said second sleeve is positioned as desired relative to said common base of said second bracket.

14. A system for mounting a spotting rifle to a launcher tube, comprising:

base brackets mounted to a launcher tube for defining spaced-apart mounting platforms;

a first bracket coupled to one of said base brackets, said first bracket being U-shaped with first and second grooved legs extending from a common base to define a first slot, said common base of said first bracket being provided with a first hole therethrough;

a first sleeve capable of receiving a portion of a spotting rifle therethrough, said first sleeve slidably engaged in said first slot, said first sleeve having a threaded post extending therefrom and through said first hole;

a first threaded coupling threadably engaging said threaded post of said first sleeve;

a first set screw mechanism for locking said first sleeve laterally in said first slot when said first sleeve has been positioned relative to said common base of said first bracket;

a second bracket coupled to another of said base brackets, said second bracket being U-shaped with first and second grooved legs extending from a common base to define a second slot, said common base of said second bracket being provided with a second hole therethrough, said second bracket positioned with said first and second grooved legs thereof oriented perpendicular to said first and second grooved legs of said first bracket in a plane parallel to that of said first bracket;

a second sleeve capable of receiving another portion of the spotting rifle therethrough, said second sleeve slidably engaged in said second slot, said second sleeve having a threaded post extending therefrom and through said second hole;

a second threaded coupling threadably engaging said threaded post of said second sleeve;

a second set screw mechanism for locking said second sleeve laterally in said second slot when said second sleeve has been positioned relative to said common base of said second bracket;

said base brackets in combination with said first bracket and said second bracket positioning said first sleeve coaxially with said second sleeve; and means for fixing an axial position of the spotting rifle relative to said first sleeve and said second sleeve.

15. A system as in claim 14 for use in combination with a spotting rifle having a stock positioned between said first and second brackets with a forward portion of the stock bearing against said first bracket, wherein said means for fixing comprises:

a ring fitted over the spotting rifle and indexed thereto prevent rotation thereof about the spotting rifle, said ring abutting a rear portion of the stock of the spotting rifle such that said ring is prevented from axial travel along stock, said ring further having external threads;

a tension nut fitted over the spotting rifle and threadably engaging said external threaded of said ring; and a spring fitted over the spotting rifle, said spring having an outside diameter greater than a span between said first and second grooved legs of said second bracket, said spring residing between said tension nut and said second bracket, whereby said spring is compressed between said tension nut and said bracket as said tension nut is rotated towards said second bracket.

16. A system as in claim 14 wherein said spring comprises at least one Belleville washer.

* * * * *